US005974587A

United States Patent [19]

Murai

[11] Patent Number: 5,974,587

[45] Date of Patent: Nov. 2, 1999

[54] BASEBALL GLOVE

[75] Inventor: Hideaki Murai, Osaka, Japan

[73] Assignee: KSK Co., Ltd., Akune, Japan

[21] Appl. No.: 09/128,649

[22] Filed: Aug. 4, 1998

[30] Foreign Application Priority Data

Mar. 10, 1998 [JP] Japan ..... 10-057755

[51] Int. Cl.[6] ..... A41D 13/08

[52] U.S. Cl. ..... 2/19; 2/161.1; 473/464

[58] Field of Search ..... 2/159, 161.1, 19; 473/464

[56] References Cited

U.S. PATENT DOCUMENTS 1,473,849 11/1923 Goldsmith ..... 2/19
1,545,998 7/1925 Barrett ..... 2/19
1,631,735 6/1927 Kennedy et al. ..... 2/19
1,826,851 10/1931 Whitley ..... 2/19
5,379,459 1/1995 Williams, Jr. ..... 2/161.1
5,379,460 1/1995 Aoki ..... 2/19
5,448,775 9/1995 Yamada et al. ..... 2/161.1
5,671,477 9/1997 Aoki ..... 2/19

*Primary Examiner*—Diana L. Oleksa
*Assistant Examiner*—Katherine Moran
*Attorney, Agent, or Firm*—Armstrong, Westerman, Hattori, McLeland and Naughton

[57] ABSTRACT

An improved baseball glove having an enlarged ball-catching face to enable catching a ball with ease, wherein an adjusting portion is provided between a little finger stall and a ring finger stall thereof to form a stepped portion for locating the ring finger stall on the rear side of the ball-catching face with respect to the little finger stall.

7 Claims, 11 Drawing Sheets

(a)

(b)

BASEBALL GLOVE

BACKGROUND OF THE INVENTION

1. Field of the Invention

The present invention relates to a baseball glove constructed to facilitate catching a ball with a large ball-catching face.

2. Description of the Related Art

A conventional baseball glove is constructed by inserting an inner core bag into an external bag, and the external bag body is formed by overlapping a front surface member (palmar surface member) with a back surface member and sewing them together. As shown in FIG. 11, a front surface member 52 has such a structure that a little finger piece 52*a*, a ring finger piece 52*b*, a middle finger piece 52*c*, an index finger piece 52*d* and a thumb piece 52*e* are extended from a palm piece 52*f*. V-shaped cut away portions are formed between the index finger piece 52*d* and the middle finger piece 52*c*, between the middle finger piece 52*c* and the ring finger piece 52*b*, and between the ring finger piece 52*b* and the little finger piece 52*a*. As shown in FIG. 2B, therefore, a baseball glove 50 constructed using the front surface member 52 has such a shape that an index finger stall 51*d*, a middle finger stall 51*c*, a ring finger stall 51*b*, and a little finger stall 51*a* are aligned in a straight line. As a result, the baseball glove 50 has such a shape that all the finger stalls are arranged like a letter V.

In the conventional baseball glove 50, as shown in FIG. 2B, only the innermost recess of a V-shaped portion formed by the arranged finger stalls is a ball-catching face, and it is necessary to guide a ball from an oblique direction to catch the ball. Thus, the ball-catching face is small, thereby making it difficult to catch a ball. Therefore, to catch a ball without fail, the glove must be used repeatedly to practice catching a ball. It is difficult even for a skilled professional baseball player to catch a quick hit ball or a ball hit apart.

In fact, to facilitate catching a ball, the ball-catching face is expanded by pressing inwardly the index finger stall 51*d*, the middle finger stall 51*c*, the ring finger stall 51*b*, and the little finger stall 51*a* of the glove. However, a new (newly made) baseball glove, in particular, returns to its original state by the elasticity of leather.

SUMMARY OF THE INVENTION

Therefore, an object of the present invention is to provide an improved baseball glove that succeeds in expanding the ball-catching face and facilitates catching a ball even with a new baseball glove.

The inventor of the present invention has conducted intensive studies to solve the above problem, and has developed a baseball glove characterized in that a stepped portion is formed, for locating a ring finger stall on the dorsal side of a ball-catching face with respect to a little finger stall by providing an adjusting portion between the little finger stall and the ring finger stall of the glove. The present invention provides this baseball glove.

Stated more specifically, the present invention is a baseball glove constructed by inserting an inner core bag into an external bag, wherein the external bag is composed of a front surface member and a back surface member, a predetermined gap is formed as an adjusting portion between a little finger piece and a ring finger piece extended from a palm piece in the front surface member, and the back surface member is sewed by locating the ring finger piece back with respect to the little finger piece using this gap to form a stepped portion between the little finger stall and the ring finger stall of the glove.

A fixing member is preferably provided to fix and hold the stepped portion formed by the adjusting portion between the little finger stall and the ring finger stall.

Further, a fixing member is more preferably provided to fix and hold the ring finger stall in such a manner that it is pulled on the rear side with respect to the little finger stall by inserting a string into the little finger stall and the ring finger stall of the glove and pulling the string.

The present invention also provides a baseball glove characterized in that an adjusting portion is provided between the ring finger stall and the middle finger stall of the glove to locate the middle finger stall on the dorsal side of a ball-catching face with respect to the ring finger stall and a baseball glove characterized in that an adjusting portion is provided between the middle finger stall and the index finger stall of the glove to form a stepped portion for locating the index finger stall on the rear side of the ball-catching face with respect to the middle finger stall.

DETAILED DESCRIPTION OF THE PREFERRED EMBODIMENTS

Baseball gloves according to preferred embodiments of the present invention will be described hereinunder with reference to the accompanying drawings.

Figure 1:
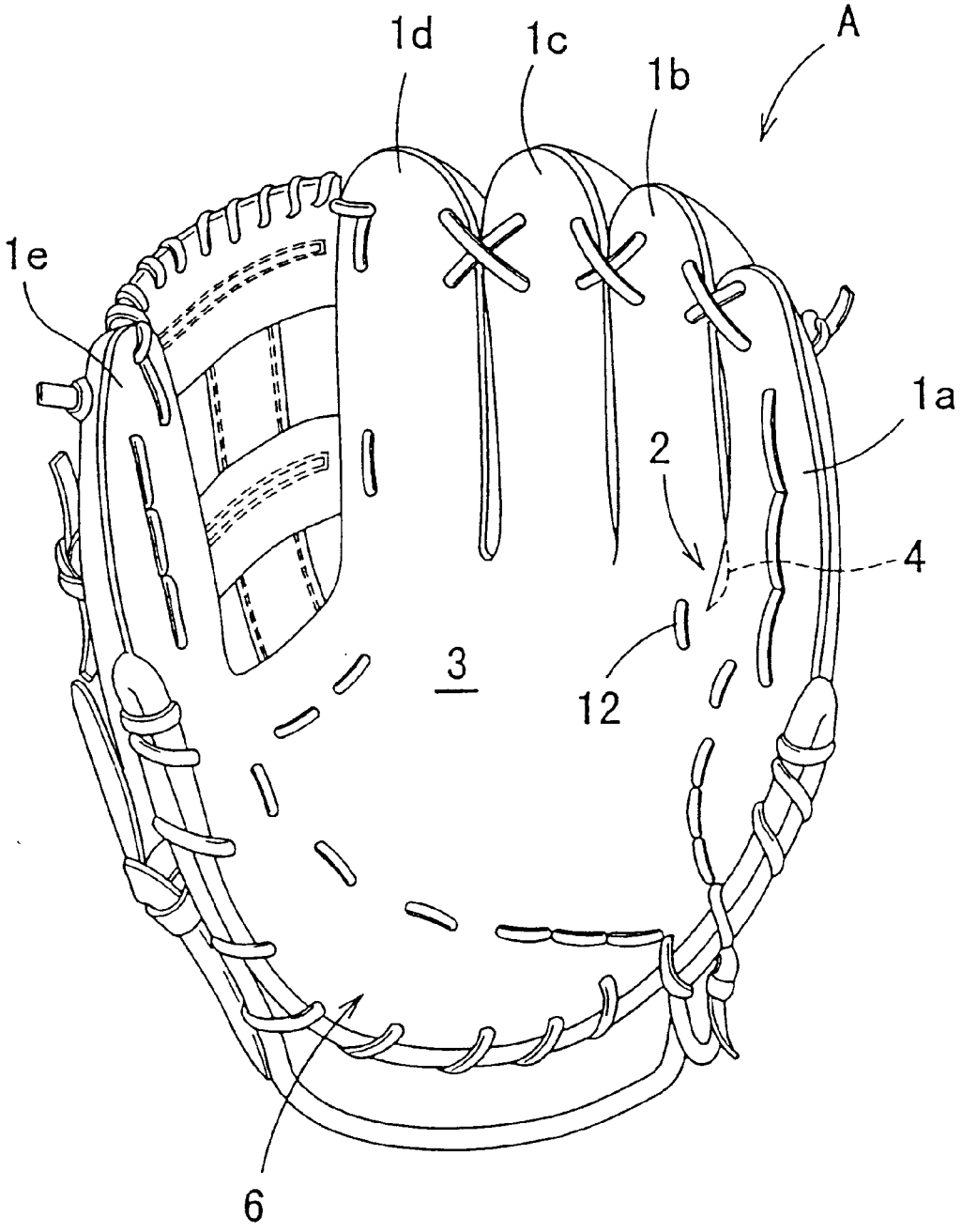
FIG. 1 is a perspective view of a baseball glove according to a first embodiment of the present invention.
Figure 2:
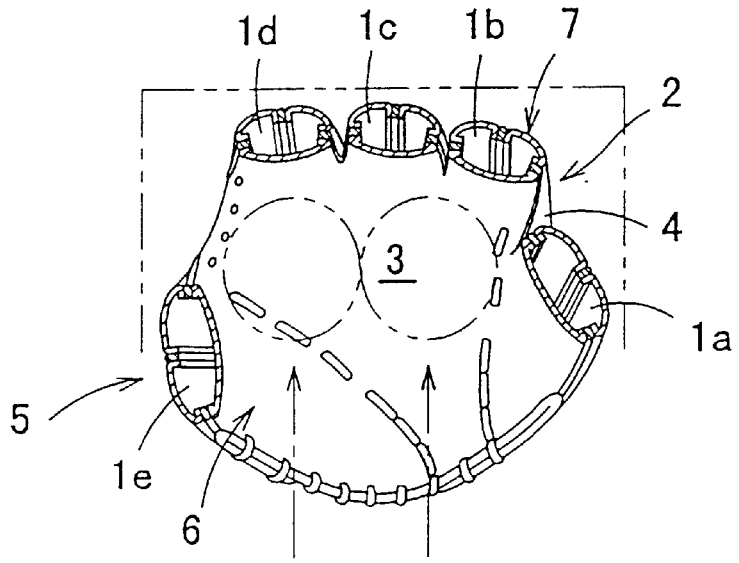
FIG. 2A is a sectional view cut along finger stalls of the baseball glove according to the first embodiment of the present invention.
FIG. 2B is a sectional view cut along the finger stalls of a conventional baseball glove.
Figure 2:
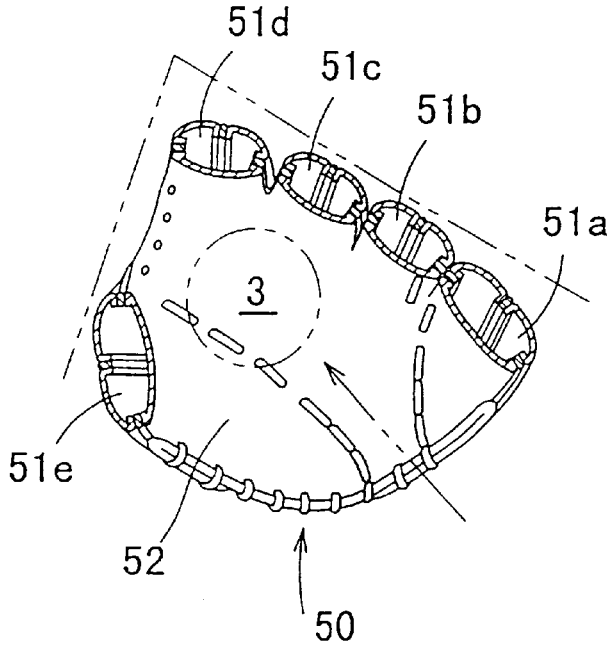

As shown in FIG. 1 and FIG. 2A, in a baseball glove A, a stepped portion 4 is formed, for locating a ring finger stall 1*b*, a middle finger stall 1*c* and an index finger stall 1*d* on the rear side of a ball-catching face 3 with respect to a little finger stall 1*a*, between the little finger stall 1*a* and the ring finger stall 1*b* by providing an adjusting portion 2 between the little finger stall 1*a* and the ring finger stall 1*b* to expand the ball-catching face 3.

Further, the baseball glove A is assembled by inserting an inner core bag into an external bag, and the external bag 5 is composed of a front surface member 6 and a back surface member 7. The front surface member 6 and the back surface member 7 are respectively provided with the adjusting portion 2 and sewed together such that the stepped portion 4 for locating the ring finger stall 1*b*, the middle finger stall 1*c* and the index finger stall 1*d* on the rear side of the ball-catching face 3 with respect to the little finger stall 1*a*, is formed between the little finger stall 1*a* and the ring finger stall 1*b* to expand the ball-catching face 3.

Figure 3:
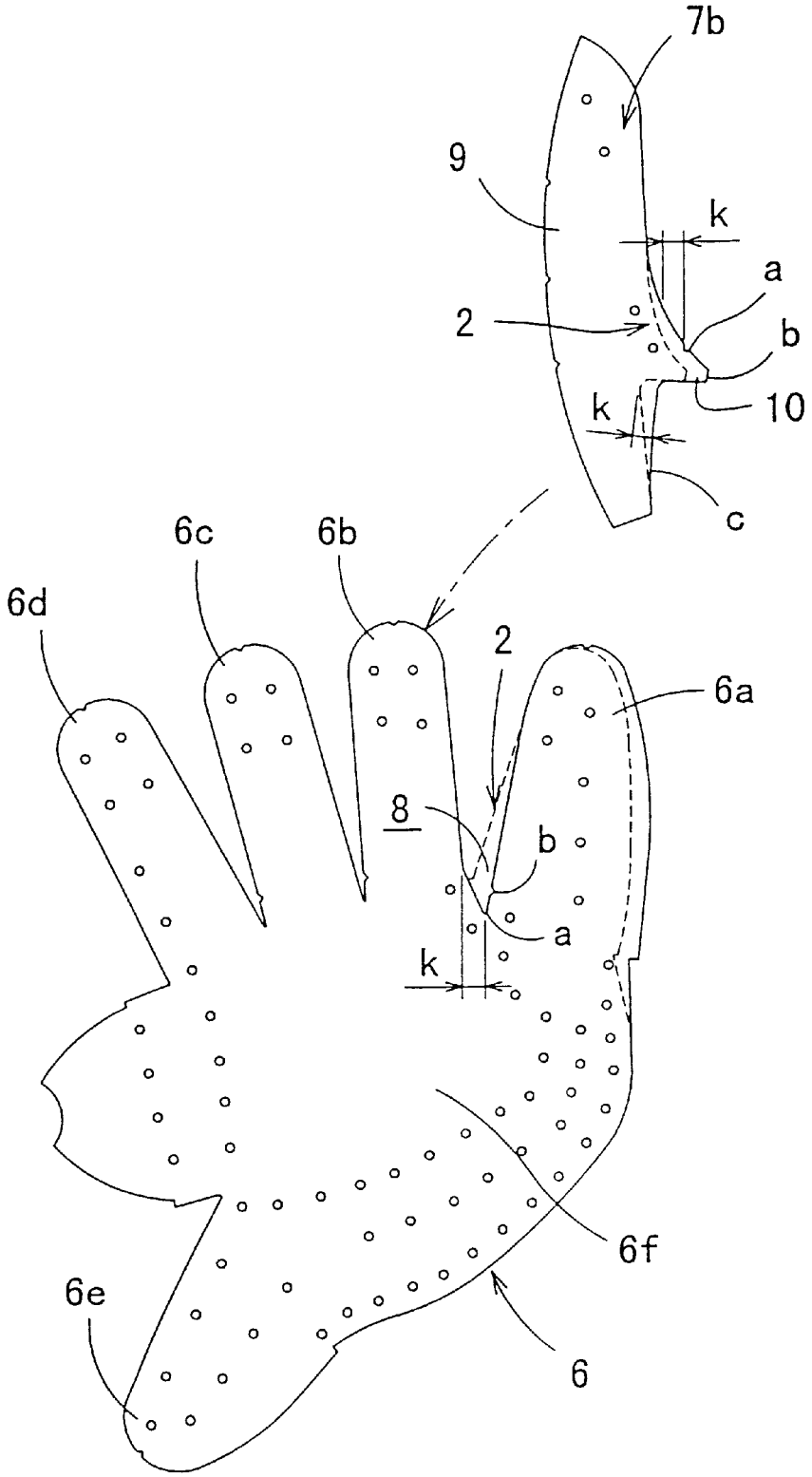
FIGS. 3A and 3B are plan views of a front surface member and a back surface member, respectively, of the baseball glove of the baseball glove of the first embodiment of the invention.
Figure 4:
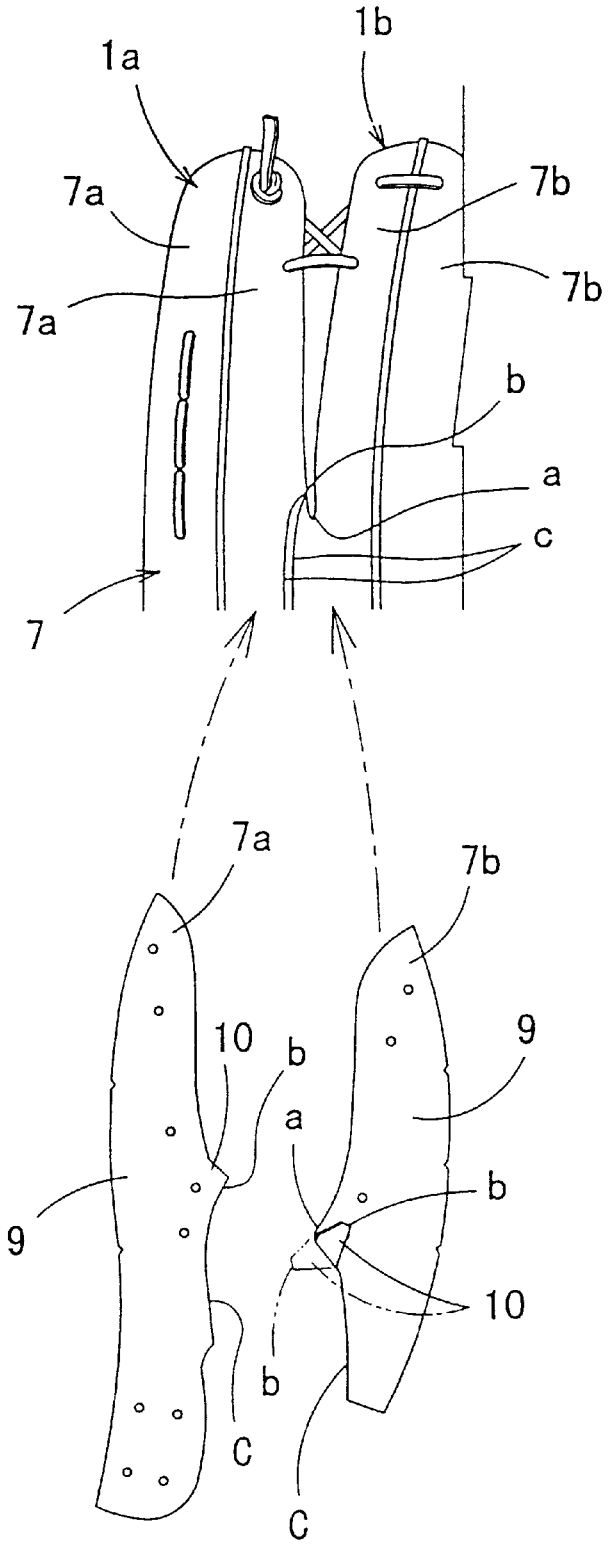
FIG. 4 is a somewhat exploded perspective view of the assembly of the finger stalls of the baseball glove when seen from a rear direction of the baseball glove of the first embodiment of the invention.
Figure 5:
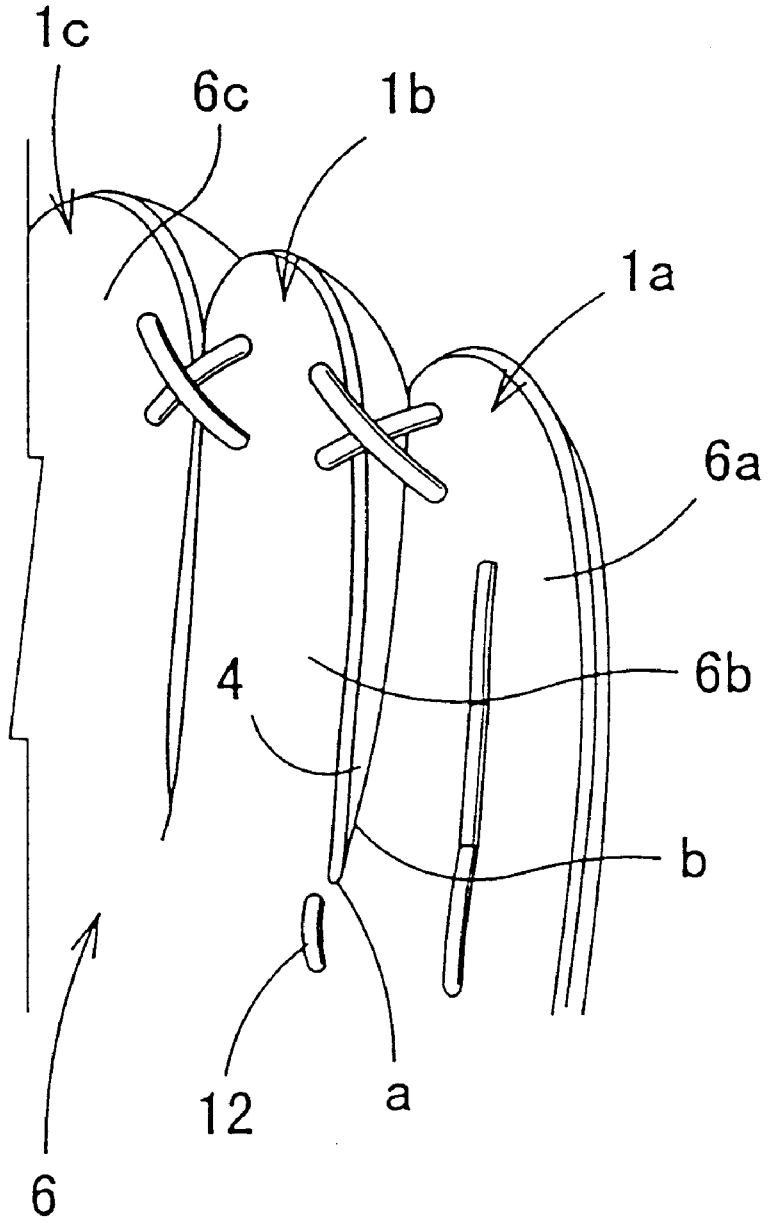
FIG. 5 is a perspective view of the finger stalls of the baseball glove when seen from a direction of a ball-catching face of the baseball glove of the first embodiment of the invention.

FIGS. 3 to 5 show the front surface member and the back surface member of the baseball glove according to a first embodiment of the present invention. In FIG. 3, the external shapes of the little finger piece of the front surface member of the prior art and the ring finger rear piece of the back surface member of the prior art are shown by dotted lines so that the difference between the front surface member of the present invention and the front surface member of the prior art can be clearly seen.

As shown in FIG. 3, the front surface member 6 has such a structure that a little finger piece 6*a*, a ring finger piece 6*b*, a middle finger piece 6*c*, an index finger piece 6*d* and a thumb piece 6*e* are extended from a palm piece 6*f*, a V-shaped cut away portion is simply formed between the index finger piece 6*d* and the middle finger piece 6*c*, and between the middle finger piece 6*c* and the ring finger piece 6*b*, a substantially V-shaped large cut away portion 8 is formed between the ring finger piece 6*b* and the little finger piece 6*a* by cutting an end portion diagonally from the middle of the ring finger piece 6*b* to the proximal end of the little finger piece 6*a* to provide a predetermined gap (distance k in FIG. 3) capable of forming the stepped portion 4 between the ring finger piece 6*b* and the little finger piece 6*a*.

The back surface member 7 of the glove is composed of two finger rear pieces divided in a longitudinal direction for each finger stall. As shown in FIG. 4, the back surface member of the little finger stall 1*a* is composed of two little finger back surface members 7*a* and 7*a* divided in a longitudinal direction, and the back surface member of the ring finger stall 1*b* is composed of two ring finger rear pieces 7*b* and 7*b* divided in a longitudinal direction. Particularly, the ring finger rear piece 7*b* next to the adjacent little finger rear pieces 7*a* has a projecting piece 10 extending from the middle of the side surface of a slender base piece 9, and the projecting piece 10 of the ring finger rear piece 7*b* is projected sideways by a distance (distance k in FIG. 3) equivalent to a level difference formed on the front surface member 6 compared with the ring finger rear piece of the prior art.

When the glove is assembled, as shown in FIGS. 3 to 5, the projecting piece 10 of the ring finger rear piece 7*b* is turned up to the rear side and sewed in such a manner that the points a and b of the ring finger rear piece 7*b* are connected to the points a and b of the front surface member 6 and the points b and c of the ring finger rear piece 7*b* are connected to the points b and c of the little finger rear piece 7*a*, respectively, thereby forming the stepped portion 4 between the little finger stall 1*a* and the ring finger stall 1*b*.

Figure 6:
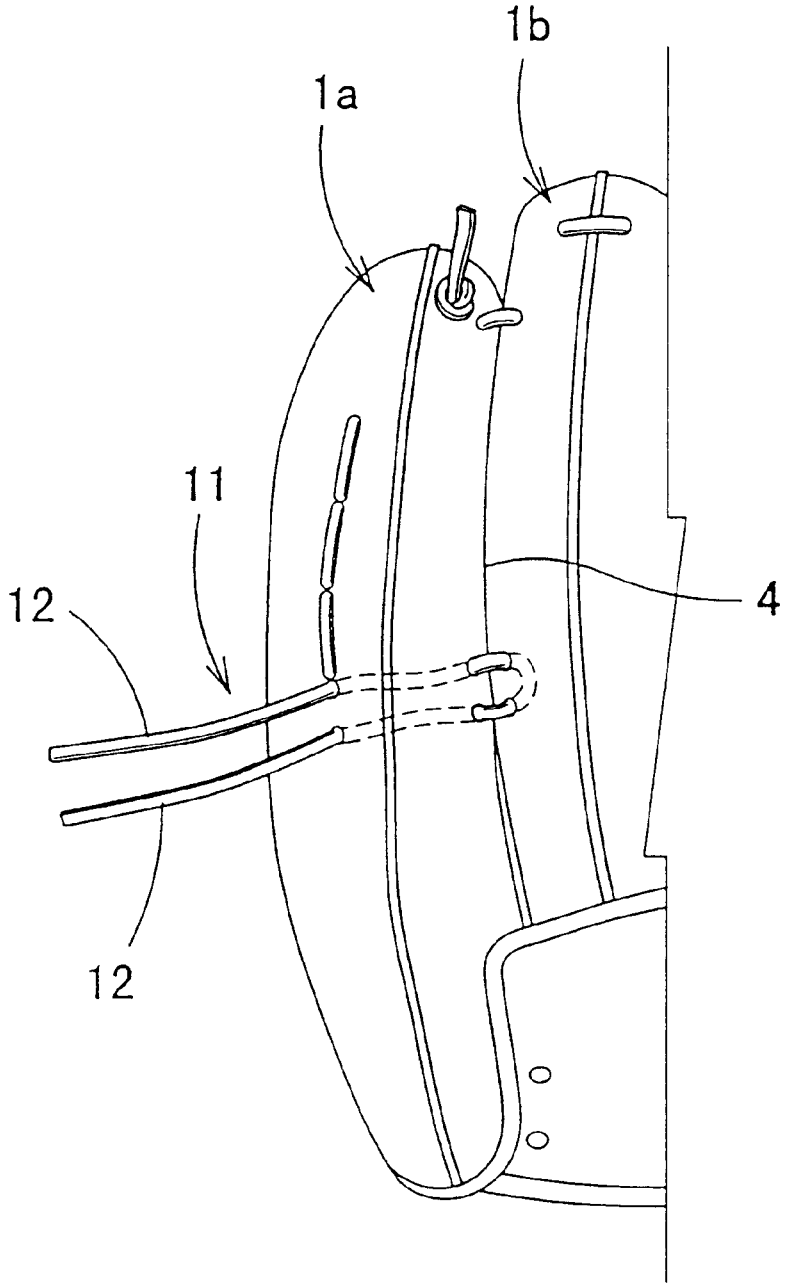
FIG. 6 is a perspective view of the rear side of the baseball glove when a fixing member is installed.

Further, the baseball glove A comprises a fixing member 11 with which the stepped portion 4 formed at the adjusting portion 2 is fixed and held between the little finger stall 1*a* and the ring finger stall 1*b*. Stated more specifically, as shown in FIG. 6, a single strip 12 is used as the fixing member 11, both ends of the strip 12 are inserted from the ball-catching face of the ring finger stall 1*b* and located on the rear side, moved in a transverse direction, inserted from the rear side of the little finger stall 1*a* and located on the ball-catching face side. Further, both ends of the string 12 can be moved in a transverse direction, inserted from the ball-catching face side of the little finger stall 1*a* and located on the rear side and tied. Thus, when both end portions of the string 12 are pulled strong and tied, the ring finger stall 1*b* is pulled back with respect to the little finger stall 1*a* so that the stepped portion 4 can be fixed and held between the little finger stall 1*a* and the ring finger stall 1*b*. Not shown, a string having a knot at one end may be inserted into the ring finger stall 1*b* and the little finger stall 1*a* sequentially like the above fixing member 11 and tied by knotting the other end thereof as the fixing member 11.

In the above baseball glove A, the string 12 is used as the fixing member 11 to fix and hold the stepped portion 4 between the little finger stall 1*a* and the ring finger stall 1*b*. However, a resin or metal member may be used to hold the stepped portion between the little finger stall 1*a* and the ring finger stall 1*b*.

When the baseball glove A is used, the front surface member 6 and the back surface member 7 are respectively provided with the adjusting portion 2 and sewed together, whereby the stepped portion 4 for locating the ring finger stall 1*b*, the middle finger stall 1*c* and the index finger stall 1*d* on the rear side of the ball-catching face 3 with respect to the little finger stall 1*a* is formed between the little finger stall 1*a* and the ring finger stall 1*b*, and, as shown in FIG. 2A, the ring finger stall 1*b*, the middle finger stall 1*c* and the index finger stall 1*d* are located back with respect to the thumb stall 1*e* and the little finger stall 1*a* located on both sides so that the whole glove is substantially U-shaped and the ball-catching face 3 can be expanded. Therefore, even when a new baseball glove is used, a ball can be easily caught and a quick hit ball and a hit ball apart can be caught.

According to the illustrated baseball glove A, when both end portions of the string 12 as the fixing member 11 are pulled strong and tied, the ring finger stall 1*b* is pulled back with respect to the little finger stall 1*a*, the stepped portion 4 is fixed between the little finger stall 1*a* and the ring finger stall 1*b*, and the ball-catching face 3 can be kept expanded, thereby facilitating a catch of a ball.

Figure 7:
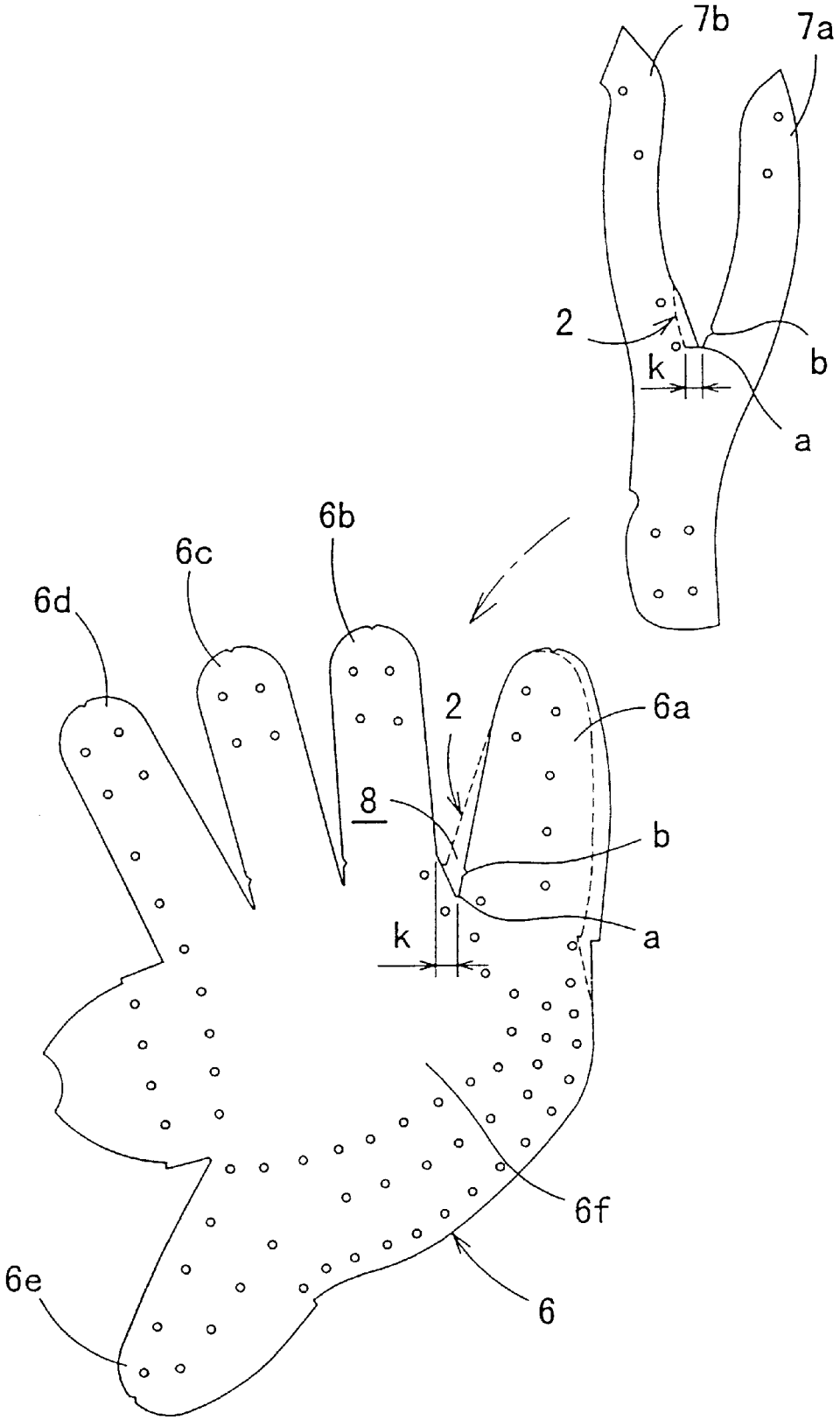
FIG. 7 is a somewhat exploded plan view of a front surface member and a back surface member of a baseball glove according to a second embodiment of the present invention.
Figure 8:
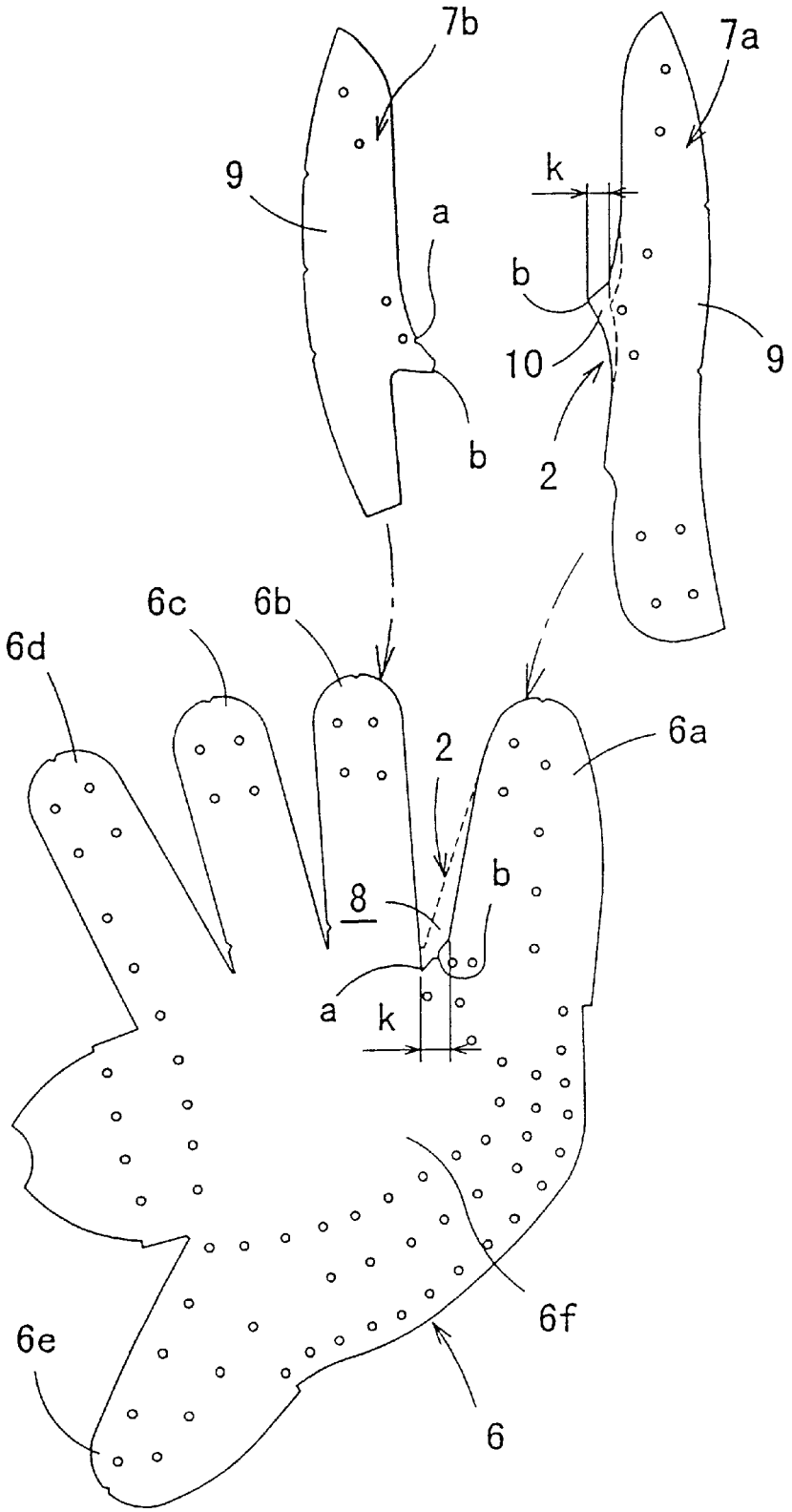
FIG. 8 is a somewhat exploded plan view of a front surface member and a back surface member of a baseball glove according to a third embodiment of the present invention.

With reference to FIG. 7 and FIG. 8, a baseball glove according to a second embodiment and a baseball glove according to a third embodiment will be described. In these figures, the external shapes of a front surface member and a back surface member of the prior art are shown by dotted lines to illustrate the differences between the front surface members of these baseball gloves of the present invention and the front surface member of the prior art.

FIG. 7 shows the front surface member and the back surface member of the baseball glove of the second embodiment. That is, the baseball glove A of FIG. 7 comprises the same surface member 6 as that of the baseball glove A of the first embodiment shown in FIG. 3. However, the back surface member 7 is a single part in which the proximal end portion of a ring finger rear piece 7*b* is connected to the proximal end portion of a little finger rear piece 7*a*. As shown in FIG. 7, compared with a conventional part shown by a dotted line, part of the proximal end portion of the ring finger rear piece 7*b* is projected by a distance (distance k in FIG. 7) that the stepped portion 4 can be formed in the front surface member 6. The baseball glove A is assembled by connecting the points a and b of the front surface member 6 to the points a and b of the back surface member 7, respectively, as shown in FIG. 7.

FIG. 8 shows the front surface member and the back surface member of the baseball glove of the third embodiment. As shown in FIG. 8, a predetermined gap (distance k in FIG. 8) capable of forming the stepped portion 4 between a ring finger piece 6*b* and a little finger piece 6*a* is provided in the front surface member 6 by forming a substantially V-shaped large cut away portion 8 between the ring finger piece 6*b* and the little finger piece 6*a* by cutting the end portion diagonally from the middle of the little finger piece 6*a* to the proximal end of the ring finger piece 6*b*. The little finger rear piece 7*a* adjacent to the ring finger rear piece 7*b* in the back surface member 7 has a triangle projecting piece 10 extended from the middle of the side surface of a slender base piece 9 as shown in FIG. 8. The projecting piece 10 of the little finger rear piece 7*a* is projected sideways by a distance (distance k in FIG. 8) equivalent to a level difference formed by the front surface member 6 compared with the little finger rear piece of the prior art. The ring finger rear piece 7*b* of the prior art is used to assemble the baseball glove by connecting the points a and b of the front surface member 6 and the point b of the little finger rear piece 7*a* of the back surface member 7 to the points a and b of the ring finger rear piece 7*b*, respectively.

Figure 9:
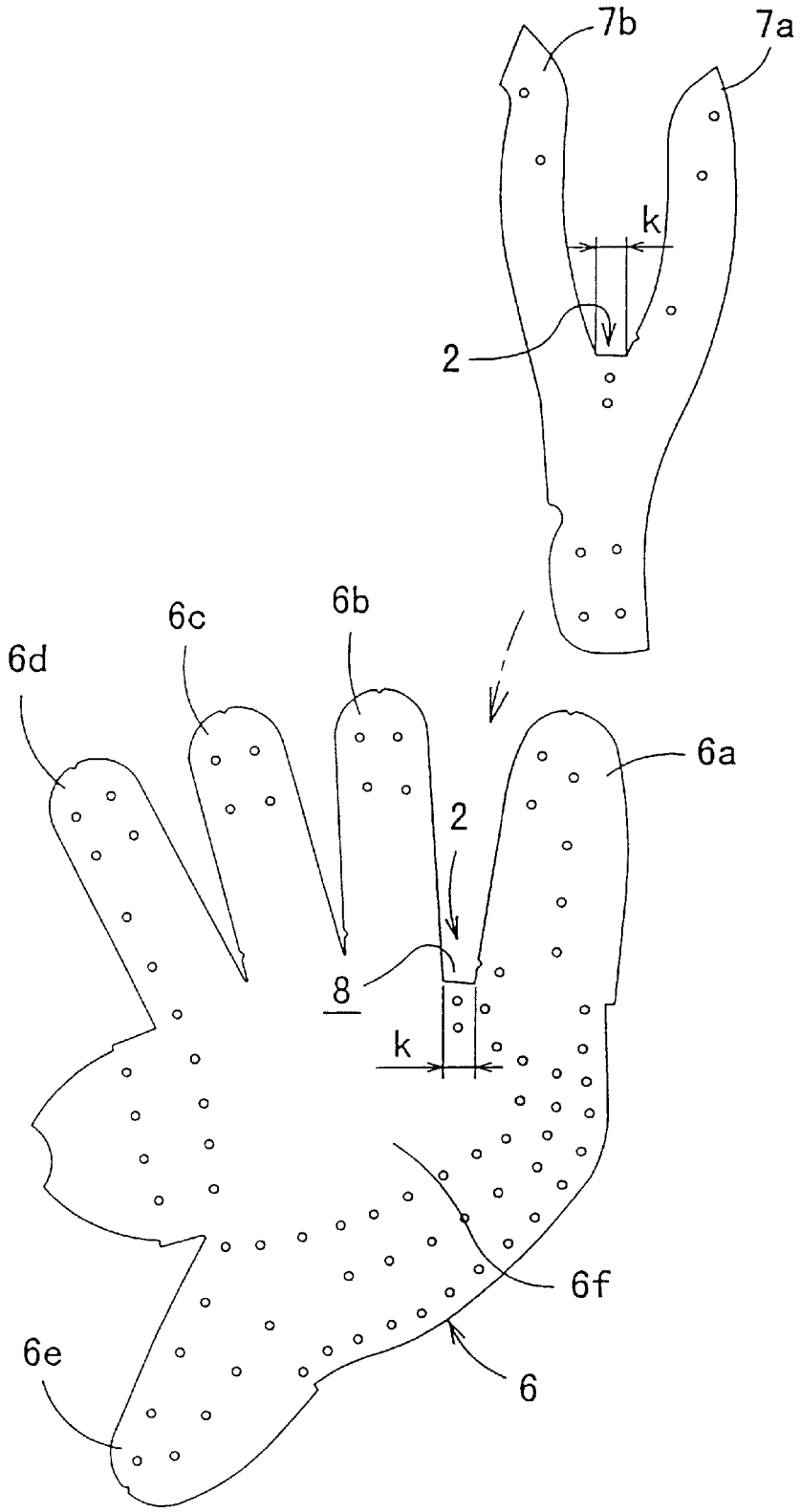
FIG. 9 is a somewhat exploded plan view of a front surface member and a back surface member of a baseball glove according to a fourth embodiment of the present invention.

FIG. 9 shows a front surface member and a back surface member of a baseball glove according to a fourth embodiment. The baseball glove A of the fourth embodiment is basically the same in structure as the baseball glove A of the second embodiment shown in FIG. 7 but differs in the front surface member 6 in which the cut away portion 8 is not formed between the ring finger piece 6*b* and the little finger piece 6*a* by cutting diagonally but a substantially U-shaped large cut away portion is formed by cutting horizontally from the proximal end of the ring finger piece 6*b* to the proximal end of the little finger piece 6*a* as shown in FIG. 9. Accordingly, the cut away portion 8 to be formed between the ring finger rear piece 7*b* and the little finger rear piece 7*a* of the back surface member 7 is changed to a substantially U-shaped large cut away portion formed by cutting horizontally from the proximal end of the ring finger rear piece 7*b* to the proximal end of the little finger rear piece 7*a*.

Figure 10:
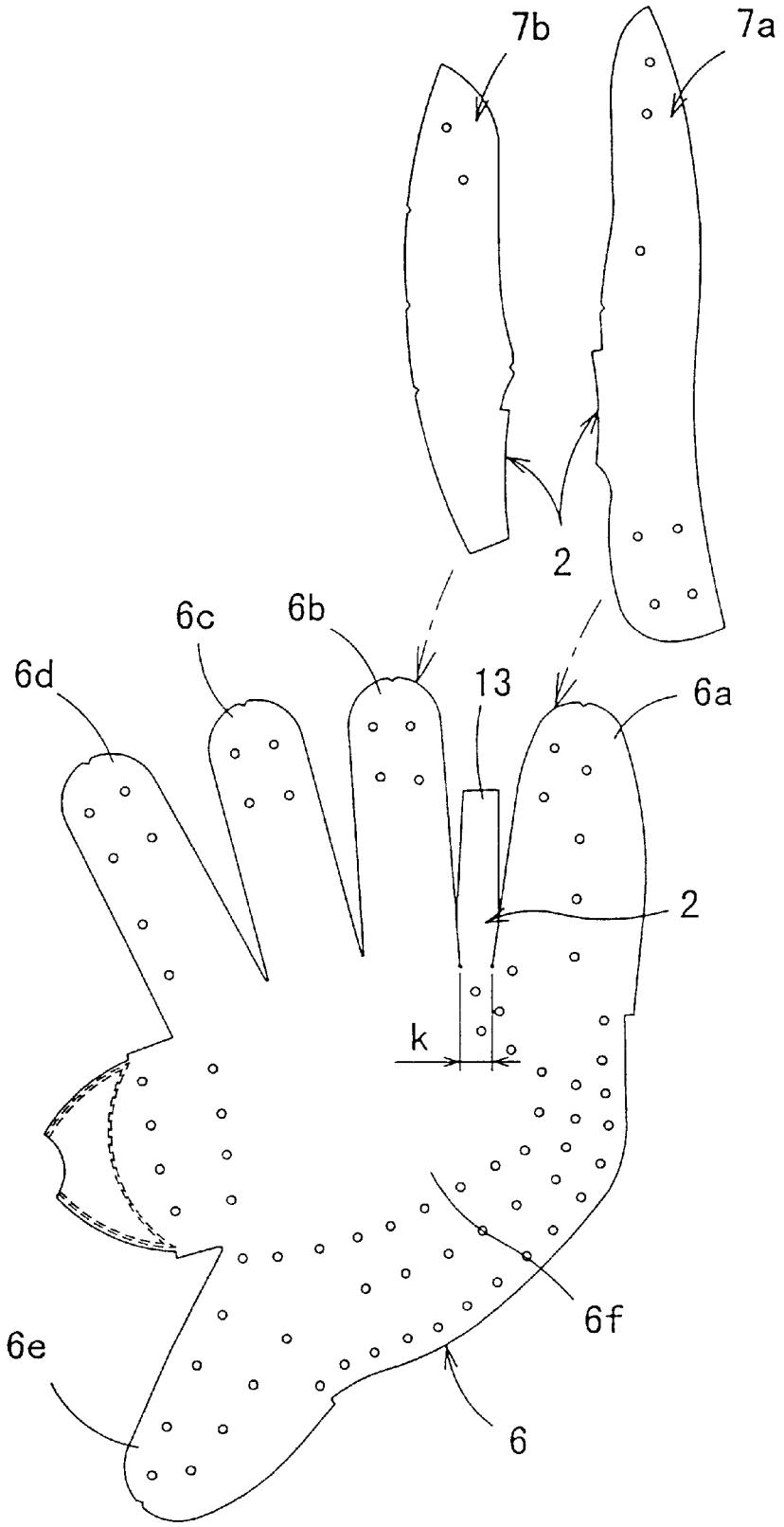
FIG. 10 is a somewhat exploded plan view of a front surface member and a back surface member of a baseball glove according to a fifth embodiment of the present invention.
Figure 11:
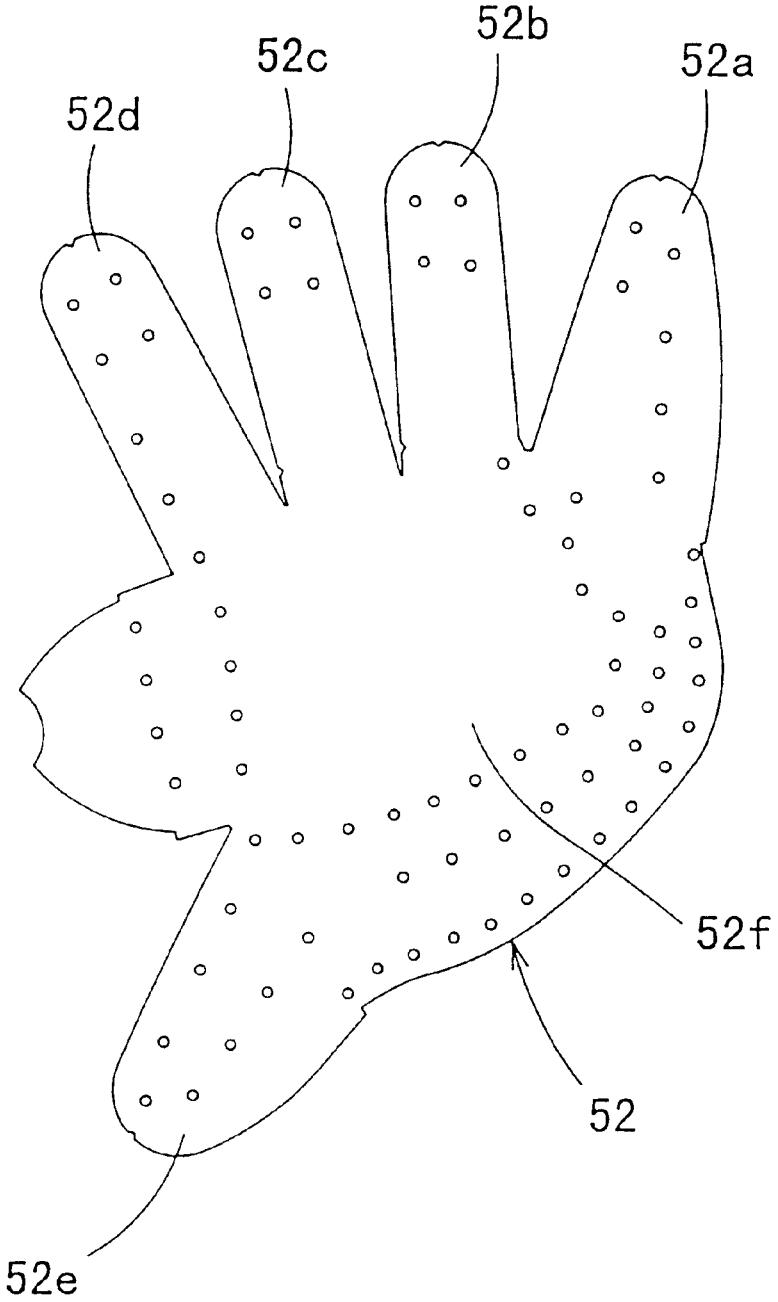
FIG. 11 is a plan view of a front surface member of the prior art.

FIG. 10 shows a front surface member and a back surface member of a baseball glove according to a fifth embodiment. As shown in FIG. 10, the front surface member 6 has an intermediate belt 13 having substantially the same width as the cut away portion 8 to be formed between the ring finger piece 6*b* and the little finger piece 6*a* of the front surface member 6 of FIG. 9 and extended from the proximal end of the cut away portion 8 to the middles of these finger pieces.

When the baseball glove A is assembled, the intermediate belt 13 of the front surface member 6 is laid over the rear side, and the ring finger rear piece 7*b* and the little finger rear piece 7*a* are placed on both sides of the intermediate belt 13 and sewed together.

In the baseball gloves of the first embodiment to the fifth embodiment, the stepped portion 4 is formed between the little finger stall 1*a* and the ring finger stall 1*b* by providing the adjusting portion 2. For example, the stepped portion 4 for locating the middle finger stall 1*c* and the index finger stall 1*d* on the rear side of the ball-catching face with respect of the ring finger stall 1*b* may be formed between the ring finger stall 1*b* and the middle finger stall 1*c* to expand the ball-catching face, or the stepped portion 4 for locating the index finger stall 1*d* on the rear side of the ball-catching face with respect to the middle finger stall 1*c* may be formed between the middle finger stall 1*c* and the index finger stall 1*d* to expand the ball-catching face.

In the above baseball glove A, the adjusting portion 2 is provided on the front surface member 6 and the back surface member 7 of the external bag. A baseball glove may be constructed by providing the adjusting portion 2 on the front surface member and the back surface member of the inner core bag likewise and inserting the inner core bag into the external bag. Further, not shown, the whole surface member 6 or the finger pieces and the proximal end portions of the finger pieces are formed from a soft material such as rubber to provide the adjusting portion 2 between finger pieces of the front surface member 6, and one of the finger pieces is elastically deformed by pulling back to form a stepped portion.

As is obvious from the above description, the following function and effect are provided.

In the baseball glove according the first aspect of the present invention, the stepped portion is formed, for locating the ring finger stall, the middle finger stall and the index finger stall on the rear side of the ball-catching face with respect to the little finger stall of the globe, between the little finger stall and the ring finger stall by the adjusting portion provided between the little finger stall and the ring finger stall of the glove. Therefore, the ring finger stall, the middle finger stall and the index finger stall are located back with respect to the thumb stall and the little finger stall located on both sides, and the whole glove is substantially V-shaped, thereby making it possible to expand the ball-catching face. As a result, even with a new baseball glove, a ball can be easily caught and a quick hit ball or a ball hit apart can be caught.

In the baseball glove according to the second aspect of the present invention, the predetermined gap is formed between the little finger piece and the ring finger piece extended from the palm piece in the front surface member by the adjusting portion provided on the front surface member and the back surface member, and the back surface member is sewed by locating back the ring finger piece with respect to the little finger piece using this gap to assemble the baseball glove. Thereby, the stepped portion can be formed between the little finger stall and the ring finger stall to expand the ball-catching face.

In the baseball glove according to the third aspect of the present invention, the stepped portion is fixed between the little finger stall and the ring finger stall by a fixing member and the ball-catching face can be kept expanded, thereby making it easy to catch a ball.

In the baseball glove according to the fourth aspect of the present invention, when both end portions of a string as a fixing member are pulled strong and tied, the ring finger stall is pulled back with respect to the little finger stall to fix the stepped portion between the little finger stall and the ring finger stall and keep the ball-catching face expanded, thereby making it more easy to catch a ball.

In the baseball glove according to the fifth aspect of the present invention, the stepped portion for locating the middle finger stall and the index finger stall on the rear side of the ball-catching face with respect to the ring finger stall of the glove is formed between the ring finger stall and the middle finger stall by the adjusting portion, and the middle finger stall and the index finger stall are located back to expand the ball-catching face.

In the baseball glove according to the sixth aspect of the present invention, the stepped portion is formed, for locating the index finger stall on the rear side of the ball-catching face with respect to the middle finger stall of the glove, between the middle finger stall and the index finger stall by the adjusting portion, and the index finger stall is located back to expand the ball-catching face.

What is claimed is:

1. A baseball glove comprising:

a front surface member including a palm portion and finger portions defining a ball-catching face, said palm portion having side edges which mutually converge toward said palm portion including a little finger portion, a ring finger portion, a middle finger portion, an index finger portion and a thumb portion extending from said palm portion;

means forming a back surface for each of said finger portions which, when sewed to said front surface member, define finger stalls including a little finger stall, a ring finger stall, a middle finger stall, an index finger stall and a thumb stall; and means for extending the ball-catching face of said glove including:

the convergence of the sides of an adjacent pair of selected finger stalls being extended apart to provide a widened gap between said finger stalls adjacent to said palm portion of said glove front surface, and an adjusting portion formed by a projection piece extending across said gap between and connecting back surfaces of said selected fingers to form a stepped portion across said gap and thereby expand the ball-catching surface of said glove.

2. A baseball glove according to claim 1, wherein said stepped portion is formed for locating said ring finger stall on the rear side of said ball-catching face with respect to said little finger stall, by providing said adjusting portion between the little finger stall and the ring finger stall of the glove.

3. The baseball glove of claim 2 which is constructed by inserting an inner core bag into an external bag, wherein the external bag is composed of said front surface member and said back surface member, said gap is formed with an adjusting portion between said little finger stall and said ring finger stall, and the back surface member is sewed to said front surface member by locating back the ring finger portion with respect to the little finger portion in which the gap includes a stepped portion formed between the little finger stall and the ring finger stall of the glove.

4. The baseball glove of claim 3, wherein a fixing member is provided to fix and hold the stepped portion formed by the adjusting portion between the little finger stall and the ring finger stall.

5. The baseball glove of claim 4, wherein said fixing member fixes and holds the ring finger stall in such a manner that the fixing member is pulled on the rear side with respect to the little finger stall by inserting a string pullable to secure adjacent finger stalls into the little finger stall and the ring finger stall of the glove.

6. A baseball glove according to claim 1, wherein said adjusting portion is provided between said ring finger stall and said middle finger stall of the glove to locate the middle finger stall on the rear side of said ball-catching face with respect to the ring finger stall.

7. A baseball glove according to claim 1, wherein said adjusting portion is provided between said middle finger stall and said index finger stall of the glove to form said stepped portion for locating the index finger stall on the rear side of the ball-catching face with respect to the middle finger stall.

* * * * *